US005312040A

United States Patent [19]

Woodward

[11] Patent Number: 5,312,040

[45] Date of Patent: May 17, 1994

[54] NON-CLOGGING SLURRY NOZZLE APPARATUS AND METHOD

[75] Inventor: Michael J. Woodward, Houston, Tex.

[73] Assignee: Aqua-Dyne, Inc., Houston, Tex.

[21] Appl. No.: 976,332

[22] Filed: Nov. 13, 1992

[51] Int. Cl.[5] ..... B05B 15/02; B24C 5/02

[52] U.S. Cl. ..... 239/1; 239/112; 239/124; 239/312; 51/415; 51/427

[58] Field of Search ..... 239/1, 104, 106, 112, 239/113, 124, 310, 312, 526, 318, 433, 428; 51/427, 415, 436, 410

[56] References Cited

U.S. PATENT DOCUMENTS

| | | | |
|---|---|---|---|
| 3,084,484 | 4/1963 | Hall et al. | 51/427 |
| 3,478,963 | 11/1969 | Winn, Jr. | 239/428 |
| 3,557,498 | 1/1971 | Lindsay | 51/427 |
| 3,612,405 | 10/1971 | Heinrich | 239/433 |
| 3,881,656 | 5/1975 | Markfelt et al. | 239/433 |
| 3,949,937 | 4/1976 | Sortwell et al. | 239/112 |
| 4,349,154 | 9/1982 | Pacht | 239/124 |
| 4,534,139 | 8/1985 | Desjardins | 51/427 |
| 4,602,740 | 7/1986 | Stachowiak | 239/124 |
| 5,054,249 | 10/1991 | Rankin | 51/439 |

*Primary Examiner*—Karen B. Merritt

*Attorney, Agent, or Firm*—Alton W. Payne; David M. O'Brian

[57] ABSTRACT

The present invention relates generally to a non-clogging slurry nozzle apparatus and method for avoiding blockages in slurry nozzles associated with the jetting of mixtures of soluble and/or insoluble abrasives and high pressure fluids. The apparatus involves the use of a pressure actuator which opens and closes gates of a valve, permitting a compressed gas to enter the nozzle and remove all abrasive material from a nozzle when jetting is interrupted, thus preventing the abrasive material to remain in the nozzle where it may adhere with residual moisture and form blockages. The present invention lessens the opportunity for abrasive material blockages in slurry nozzles and improves the efficiency of cleaning operations by reducing the need to interrupt blasting operations to remove abrasive blockages from the slurry nozzle.

17 Claims, 5 Drawing Sheets

NON-CLOGGING SLURRY NOZZLE APPARATUS AND METHOD

FIELD OF THE INVENTION

The present invention relates generally to a nozzle apparatus and method for avoiding blockages in the nozzle associated with interrupting the jetting of mixtures of soluble and/or insoluble abrasive particles and high pressure fluids. Specifically, the present invention relates to an automatic apparatus and method for removing abrasive from a slurry nozzle during periods when the jetting operation is interrupted.

BACKGROUND OF THE INVENTION

For many decades prior to the mid-1980's, conventional sandblasting using silica sand and compressed air was the preferred cleaning method for removing debris, rust, scale, coatings and corrosion from various surfaces. Conventional sandblasting was used to clean the exterior surfaces of buildings, equipment, vehicles, structures and the interior and exterior surfaces of pipe. Conventional sandblasting was inexpensive, highly effective for specific applications and provided a desirable anchor pattern for sealants and coatings to adhere. During the mid-1980's, the silica dust associated with conventional sandblasting was found to be a leading cause of Silicosis and conventional sandblasting was largely discontinued.

Although conventional sandblasting was greatly reduced, the demand for high pressure abrasive cleaning increased. Sandblasters began to experiment with their conventional sandblasting equipment by adding water to the silica sand to reduce the dust. Water/sandblasters then encountered a new problem of rusting and corroding equipment. Water/sandblasters added rust inhibitor to their water supply to combat the rust and corrosion problems, which increased their operational costs.

Water blasting, using only high pressure jets of water, has been for many years an effective means of removing some forms of debris and scale. Water blasting has many attributes, including: environmental safety, causing little damage to the surface of the object being cleaned, a relatively inexpensive blast medium and requiring little or no clean-up. However, water blasting still does not produce the abrasive forces of conventional sandblasting. Water blasting does not produce anchor patterns for sealants and coatings to adhere and water blasting alone is not practical for "hanging" applications where the operator is suspended by rope or cable above the ground, e.g. cleaning water towers, etc.

The water blast industry has, for the past several years, experimented with diverse high pressure fluid mediums and various types of soluble and insoluble abrasives for cleaning and blasting purposes. The use of abrasives in combination with high pressure fluids, is a well known material for use in water blasting applications. Insoluble abrasives such as plastic pellets and silica sand may not be environmentally safe, routinely clog the slurry nozzle, must be restricted in type and area of use and generally result in an extensive clean-up operation. Experimentation with soluble abrasives such as bicarbonate of soda in combination with a high pressure fluid medium has produced improved abrasive forces, has increased the number of water blast applications and has reduced the time spent on clean-up operations. The use of bicarbonate of soda is however, expensive, produces no anchor pattern and can not compete with the abrasive forces produced by silica sand. The water blast industry is currently experimenting with low cost, soluble abrasives which can produce an anchor patter and can effectively compete with dry silica sand. The problem lies in that both soluble abrasives and insoluble abrasives continue to create blockages in slurry nozzles with tremendous regularity, greatly reducing the productivity of high pressure fluid and abrasive mixture blasting. Therefore, a soluble or insoluble abrasive which may be perfect in every way still can not be effectively used due to the inherent problem of slurry nozzle blockages.

The blockage associated with slurry nozzles while using soluble or insoluble abrasives in combination with a high pressure fluid medium, centers on the contact between the abrasive and the residual moisture in the slurry nozzle, wherein the mixture of abrasive and moisture is not jetted from the slurry nozzle but is permitted to remain at rest in the slurry nozzle. This circumstance is common when the operator momentarily or during an extended amount of time, interrupts the water jetting operation. Contact between the abrasive and the high pressure fluid while the slurry nozzle is jetting the mixture does not generally cause blockage. During periods of interruption, residual moisture from the high pressure fluid medium is inherently present in the nozzle and unless all of the abrasive is removed from the slurry nozzle during the jetting interruption, the residual moisture reacts with the abrasive to bond the abrasive to itself and the surrounding inner nozzle surface and form a blockage. During an interruption in jetting where soluble abrasive is used, the reaction between the residual moisture and abrasive in the slurry nozzle can cause the abrasive to bond together, taking the shape of the interior passage of the slurry nozzle and completely block the nozzle. Such blockages are the most extreme and require the operator to stop the cleaning operation, disassemble the slurry nozzle apparatus, remove the blockage or repair the slurry nozzle and reassemble the slurry nozzle apparatus. Blockages rarely occur near suitable repair areas and normally occur while using the slurry nozzle at a remote location, making repair unpredictible and burdensome. Often, the blockage is so compacted and difficult to remove that the nozzle or components of the nozzle must simply be discarded and replaced.

Slurry nozzle blockages are expensive in terms of time, money and lost opportunity. Of primary importance in the present invention is to enable a slurry nozzle to be interrupted during its jetting operations while using some combination of soluble and/or insoluble abrasive and high pressure fluid, such that all of the abrasive will be removed from the nozzle and blockage normally associated with the residual moisture and abrasive will be eliminated.

It is, therefore, a feature of the present invention to provide a non-clogging high pressure slurry nozzle that prevents blockages in the slurry nozzle.

Yet another feature of the present invention is to provide a non-clogging high pressure slurry nozzle that prevents blockages in the slurry nozzle when the high pressure fluid blasting operations are interrupted.

Yet another feature of the present invention is to provide a non-clogging high pressure slurry nozzle that prevents blockages in the slurry nozzle when the high pressure fluid blasting operations are interrupted without shutting down the cleaning operation or harming the operator or surface to be cleaned.

Still another feature of the present invention is to provide a non-clogging slurry nozzle apparatus that removes abrasive material from the slurry nozzle, not requiring any affirmative action on the part of the operator.

Yet another feature of the present invention is to provide a non-clogging slurry nozzle apparatus wherein the means to remove abrasive from the nozzle includes a supply of compressed gas which forces the abrasive out of the slurry nozzle.

Another feature of the present invention is to provide a non-clogging slurry nozzle apparatus for removing abrasive from the nozzle using compressed gas which forces the abrasive out of the slurry nozzle when high pressure fluid blasting operations are interrupted.

Still another feature of the present invention is to provide a non-clogging slurry nozzle apparatus which includes a pressure actuator to control the flow of abrasive material and compressed gas through a 3-way valve to the high pressure slurry nozzle.

Yet another feature of the present invention is to provide a non-clogging slurry nozzle apparatus which includes a pressure actuator which may function under the principles of electronics, pneumatics or hydraulics.

Another feature of the present invention is to provide a method for preventing abrasive blockages in high pressure slurry nozzles.

Additional features and advantages of the invention will be set forth in part in the description which follows, and in part will become apparent from the description, or may be learned by practice of the invention. Features and advantages of the invention may be realized by means of the combinations and steps particularly pointed out in the appended claims.

SUMMARY OF THE INVENTION

To achieve the foregoing objects, features, and advantages in accordance with the purpose of the invention as embodied and broadly described herein, a non-clogging high pressure slurry nozzle apparatus and method is provided which removes abrasive material from the high pressure slurry nozzle and, thereby, prevents blockage in the slurry nozzle when the operator interrupts the jetting operations.

The high pressure non-clogging slurry nozzle apparatus includes a nozzle for receiving the high pressure fluid stream with a first orifice through which the high pressure fluid stream passes and a second orifice through which either abrasive material or a compressed gas passes. The non-clogging slurry nozzle apparatus includes a switch for directing the high pressure fluid stream through the first orifice or away from the first orifice and a dump means for venting the high pressure fluid stream away from the first orifice. A high pressure fluid pump or other source of high pressure fluid is used to supply the high pressure fluid stream to the first orifice. The non-clogging, high pressure slurry nozzle apparatus also includes a pressure actuator switch in communication with a source of high pressure fluid and has a pressure sensing means. A valve for controlling the flow of abrasive material or compressed gas flowing to a second orifice of the nozzle is also included in the non-clogging, high pressure slurry nozzle apparatus. Compressed gas is used to remove the abrasive material from the high pressure slurry nozzle and the second orifice, during periods of interruprion in the jetting operations.

SUMMARY OF THE METHOD

To achieve the foregoing objects, features, and advantages in accordance with the purpose of the invention as embodied and broadly described herein, a method for preventing abrasive material blockages in a high pressure slurry nozzle is described herein.

The method for preventing abrasive material blockages in a high pressure slurry nozzle includes mixing a high pressure liquid stream with an abrasive material in the nozzle, interrupting the flow of abrasive material and engaging a compressed gas with the nozzle for removing the abrasive material to prevent blockage of the nozzle.

BRIEF DESCRIPTION OF THE DRAWINGS

The accompanying drawings which are incorporated in and constitute a part of the specification, illustrate the preferred embodiments of the invention and together with the general description of the invention given below, serve to explain the principles of the invention.

The above general description and the following detailed description are merely illustrative of the generic invention, and additional modes, advantages, and particulars of this invention will be readily suggested to those skilled in the art without departing from the spirit and scope of the invention.

DESCRIPTION OF THE PREFERRED EMBODIMENTS

Reference will now be made in detail to the present preferred embodiments of the invention and the method of preventing abrasive material blockages in high pressure slurry nozzles as described in the accompanying drawings.

Figure 1:
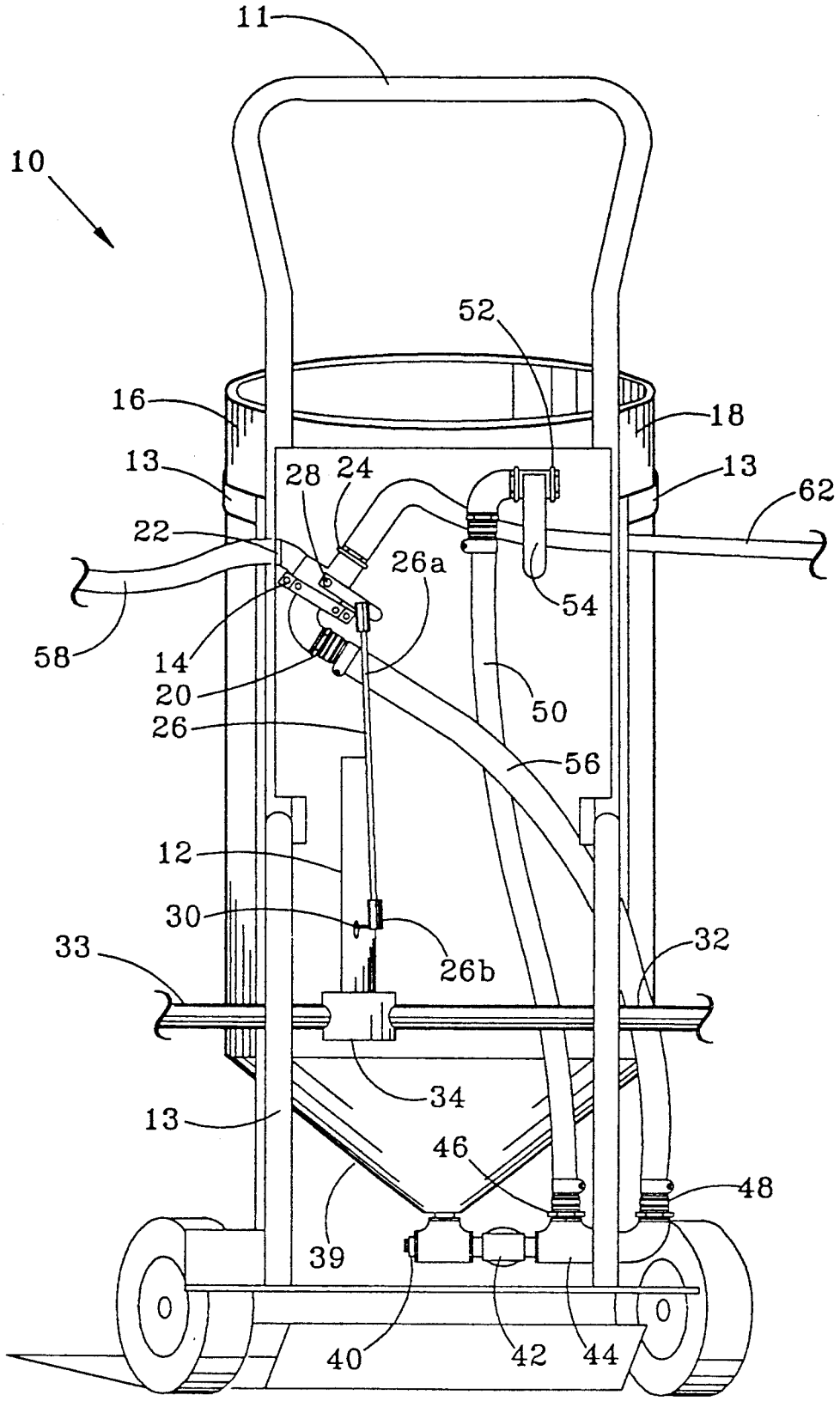
FIG. 1 is a front view of the apparatus of the present invention illustrating the assemblage of the preferred embodiment.
Figure 3:
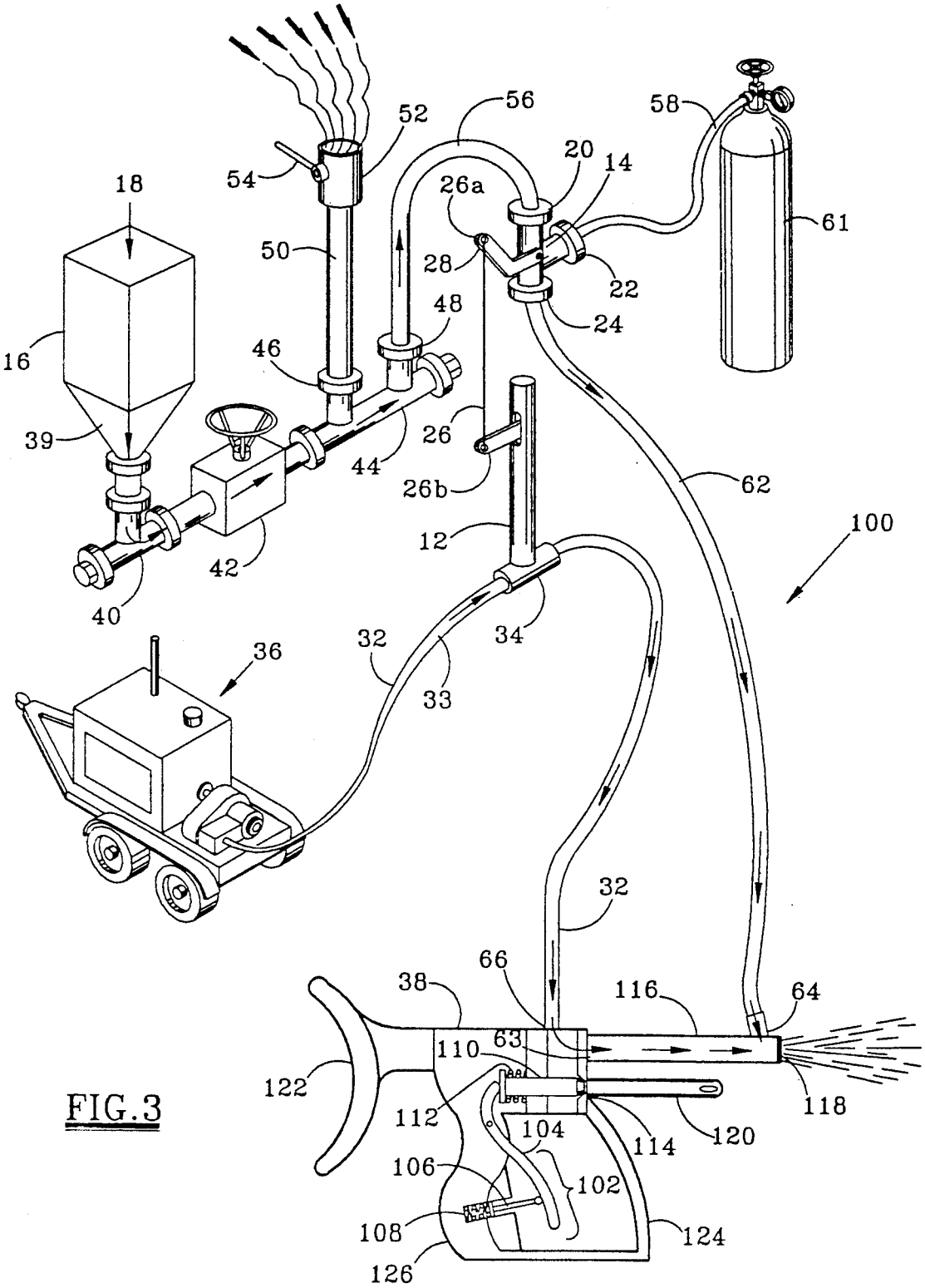
FIG. 3 is a perspective diagram illustrating the operation of the preferred embodiment of the present invention during jetting operations, including the flow of material.
Figure 4:
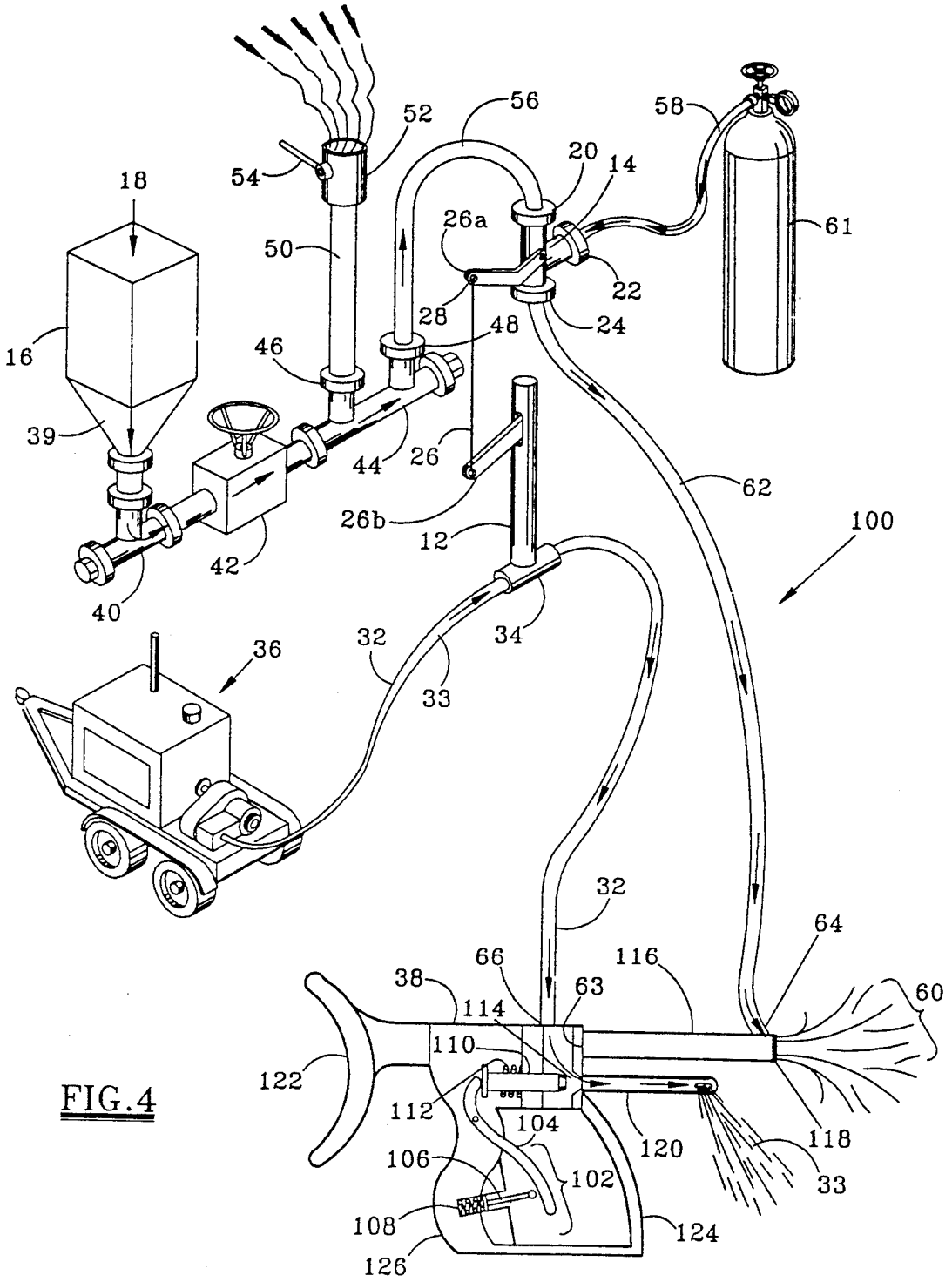
FIG. 4 is a perspective diagram illustrating the operation of the preferred embodiment of the present invention during an interruption of the jetting operations, including the flow of material.

FIG. 1 is a front view of an abrasive dispenser 10 as practiced by the present invention. The abrasive dispenser 10 includes a pressure actuator 12 and a 3-way valve 14 which control flow from a gravity-feed hopper 16 containing an amount of abrasive material 18. The abrasive dispenser 10 can be mounted on a two-wheel hand cart 11 using a plurality of support members 13 for added mobility. The 3-way valve 14 has a first inlet 20, a second inlet 22, a single outlet 24 and a switching lever 28 to selectively close the first inlet 20 or the second inlet 22. The 3-way valve 14 is mechanically linked to the pressure actuator 12 by way of a connecting rod 26. A first end **26*a* of the rod 26 is affixed to the switching lever 28. A second end 26*b* of the rod 26 is affixed to a switching lever 30 of the pressure actuator 12**. The pressure actuator 12 directly communicates with a high pressure fluid conduit 32 through a coupling 34 and reacts to changes in pressure within the high pressure fluid conduit 32. As illustrated in FIGS. 3 and 4, the high pressure fluid conduit 32 transmits a high pressure fluid stream 33 from a high pressure fluid pump 36 through the coupling 34 to a high pressure spray gun 38. The high pressure fluid pump 36 of the preferred embodiment is an Aqua-Dyne EK-series high pressure pump (Aqua-Dyne, Incorporated, Houston, Tex.).

As depicted in FIG. 1, the gravity-feed hopper 16 has a funnel shaped base 39 which transmits the abrasive material 18 into a first conduit member 40 which in turn transmits the abrasive material 18 to a gate valve 42. The gate valve 42 is incrementally opened or closed to a desired setting to control the volume of abrasive material 18 allowed to pass through the gate valve 42. After passing through the gate valve 42, the abrasive material 18 enters a second conduit member 44 which has an air inlet 46 and a conduit outlet 48. The air inlet 46 assists the gate valve 42 in allowing a predetermined volume of abrasive material 18 to exit from the hopper 16. The air inlet 46 is connected to a first air conduit 50 and a valve 52. The valve 52 includes a lever 54 to adjust the volume of air permitted to enter the air inlet 46. The conduit outlet 48 transmits abrasive material 18 to a first abrasive feed conduit 56, which in turn transmits abrasive 18 to the first inlet 20 of the 3-way valve 14. The second inlet 22 of 3-way valve 14 is engaged to a second air conduit 58 which transmits high pressure gas 60 from a source of high pressure gas 61 to the 3-way valve 14. The outlet 24 of the 3-way valve 14 transmits either abrasive material 18 from the first inlet 20 or compressed gas 60 from the second inlet 22, to a high pressure flow conduit 62.

Referring now to FIGS. 1, 3 and 4, the flow conduit 62 transmits either abrasive material 18 or compressed gas 60 from a gas source 61 to a second orifice 64, depending upon the positioning of the switching lever 28. The high pressure fluid conduit 32 enters the high pressure spray gun 38 at an inlet 66.

Figure 2:
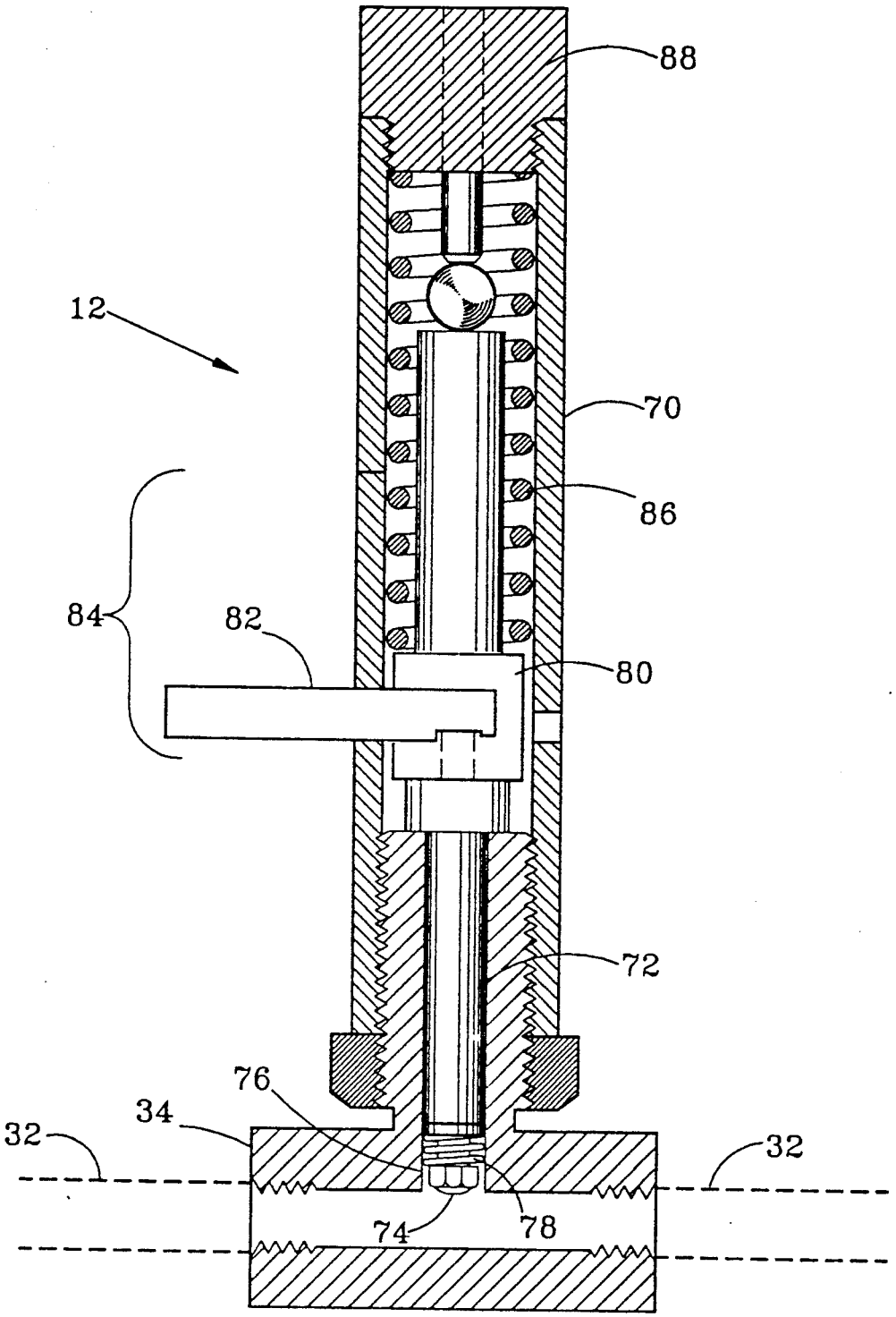
FIG. 2 is a cut-away view of a preferred embodiment of the pressure actuator encompassed by the present invention.

FIG. 2 illustrates a cut-away view of the preferred embodiment of the pressure actuator 12. It is important to note that while FIG. 2 illustrates the pressure actuator 12 comprised of a mechanical and hydraulic assembly, alternate embodiments of the pressure actuator could be comprised of electrical, pneumatic or hydraulic means. A person skilled in the art might appreciate an electrical pressure transducer being substituted for the pressure actuator 12 having pressure sensing means as used in the present invention. The pressure actuator 12 is comprised of a body 70 and a coupling 34. The coupling 34 transmits fluid pressure from the high pressure fluid conduit 32 to a pressure pin 72 positioned concentrically within the body 70 and perpendicularly with the fluid conduit 32. The pressure pin 72 includes a nut and bolt assembly 74 disposed within a recess 76 in the coupling 34. The high pressure fluid stream 33 from the coupling 34 is prevented from entering the body 70 through the placement of a seal 78 between the pressure pin 72 and the nut and bolt assembly 74. The seal 78 radially fills the opening 76. The pressure pin 72 engages a spool 80 which secures a connecting pin 82 for attachment to the end 26*b* of the connecting rod 26. The spool 80 moves linearly within the body 70 allowing the connecting pin 82 to repetitiously move disposed from an aperture 84. The spool 80 moves longitudinally due to the longitudinal movement of the pressure pin 72 as it reacts to changes in the fluid pressure within the coupling 34. A coil spring 86 maintains tension on the spool 80 such that when the fluid pressure is low within the coupling 34, the connecting pin 82 shifts in the direction of the coupling 34 and closes the first inlet 20 and opens the second inlet 22 allowing compressed gas to enter the flow conduit 62.

When a sufficient amount of fluid pressure is detected within the coupling 34, for example, 1,000 psi, then the pressure pin 72 begins to move the spool 80 against the coil spring 86 and the connecting pin 82 is moved away from the coupling 34 and moves the switching lever 28 via the connecting rod 26. The coil spring 86 is secured laterally within the body 70 and is secured longitudinally by a cap 88 which threadably engages the body 70.

FIG. 3 is a perspective diagram illustrating the preferred embodiment of the present invention during jetting operations illustrating the flow of material. The high pressure spray gun 38 includes a trigger mechanism 102, comprised of a pivot mounted lever 104, a plunger 106, a first spring 108 to maintain pressure on the plunger 106, a reversible valve 110 and a second spring 112 to return the valve 110 to an open position, in the absence of pressure being applied to the valve 110 from lever 104. When compression is applied to the lever 104, pressure is applied to the valve 110 and the spring 112 is compressed, forcing the valve 110 to close the valve dump inlet 114, preventing high pressure fluid stream 33 flow through a nozzle dump 120 and results in forcing the high pressure fluid stream 33, entering through the inlet 66 and the first orifice 63 to proceed down a barrel 116. The first orifice 63 is up stream of the second orifice 64. The high pressure fluid stream 33 flowing through the barrel 116 encounters abrasive material 18 at the second orifice 64 and the comingling of abrasive material 18 and high pressure fluid stream 33 then departs a slurry nozzle 118. Preferably the slurry nozzle 118 is the nozzle depicted in U.S. Pat. No. 5,054,249, to Rankin. The nozzle 118 and the second orifice 64 are the primary areas where nozzle blockages in the prior art occur. The high pressure spray gun 38 may further include a shoulder engaging buttstock 122, a trigger guard 124 and a handle 126.

Referring now to FIG. 4, a perspective diagram illustrates a preferred embodiment of the present invention wherein the operator has interrupted the jetting operation of the high pressure spray gun 38 and high pressure fluid stream 33 is flowing through the dump inlet 114 and the nozzle dump 120.

OPERATION

Referring now to FIG. 3, when high pressure fluid flow through the non-clogging slurry nozzle apparatus 100 is not interrupted, the trigger mechanism 102 is compressed, the seat valve 110 closes off the nozzle dump 120 and high pressure fluid stream 33 enters the inlet 66 then proceeds to first orifice 63 and through the barrel 116 to the second orifice 64 where the abrasive material 18 from the flow conduit 62 contacts the high pressure fluid stream 33 and the mixture is jetted out of the slurry nozzle 118. As long as high pressure fluid stream 33 flows through the barrel 116 and is not interrupted, the high pressure fluid stream 33 flow will prevent blockages from occuring in barrel 116 or the second orifice 64 or the slurry nozzle 118. Blockages arise when the high pressure fluid stream 33 flow through orifice 63 and barrel 116 is interrupted.

As illustrated in FIG. 4, when high pressure fluid stream 33 flow through the non-clogging slurry nozzle 118 is interrupted and the trigger mechanism 102 is not under compression, the high pressure fluid stream 33 from the high pressure fluid pump 36 is conveyed through the high pressure fluid conduit 32 to the high pressure spray gun 38 and directed to the nozzle dump 120. The high pressure fluid stream 33 flowing to the nozzle dump 120 flows relatively unrestricted and decreases the pressure greatly in the high pressure fluid conduit 32 causing the pressure actuator 12 to sense a pressure drop. During this interrupted flow period, the connecting pin 82 of the pressure actuator 12 moves the connecting rod 26 to close the abrasive inlet 20 of the 3-way valve 14 and opens the valve inlet 22 of the 3-way valve 14 allowing only compressed gas 60 to travel through the flow conduit 62 to the second orifice 64 and thus removes all abrasive material 18 from the slurry nozzle 118. Hence, when jetting is interrupted, only compressed gas 60 and some residual moisture from the diverted high pressure fluid stream 33 will be present in the barrel 116 or the slurry nozzle 118 and blockages in the second orifice 64 and the slurry nozzle 118 will be avoided.

Figure 5:
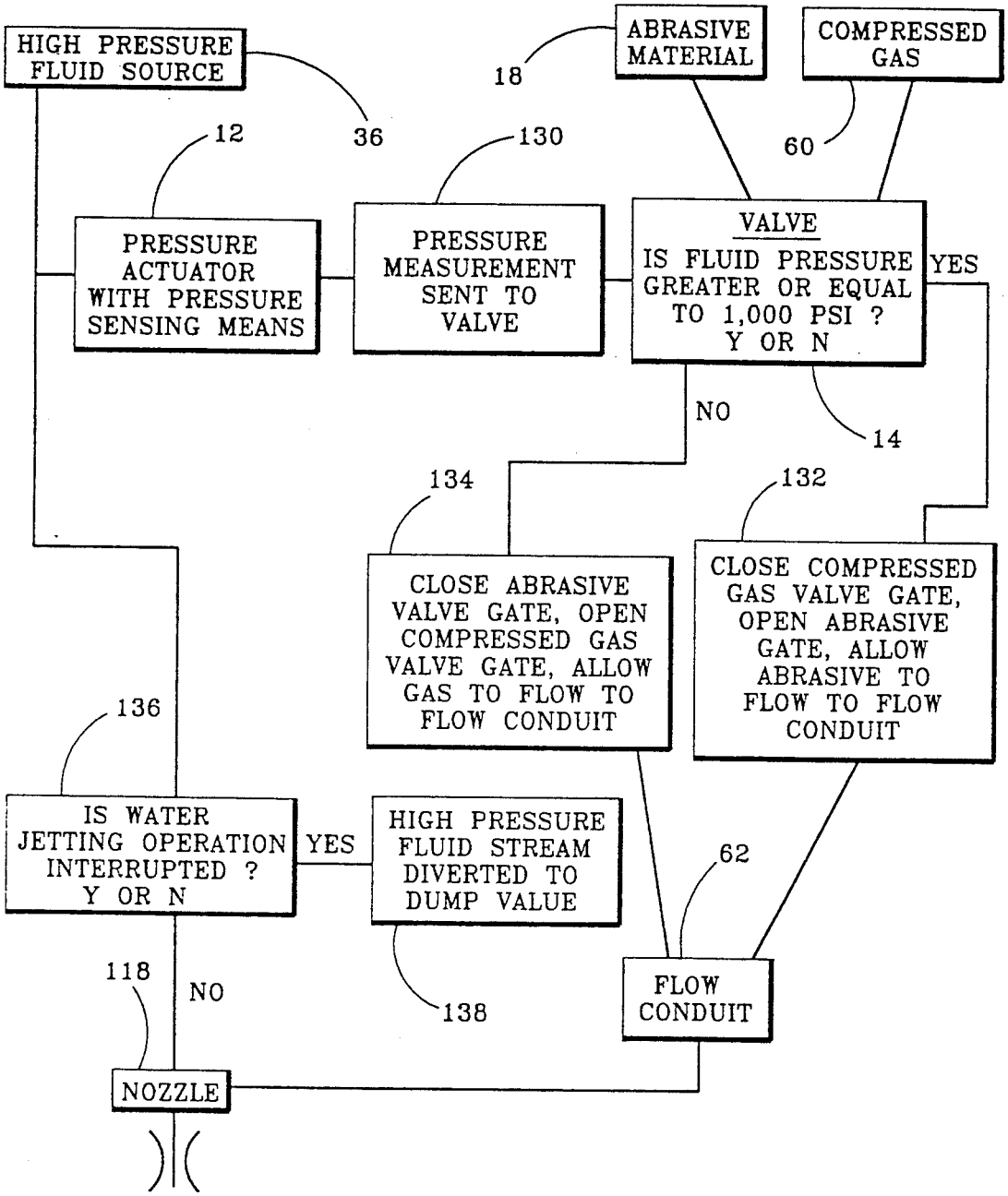
FIG. 5 is a flow diagram illustrating the method of operation of the non-clogging slurry nozzle apparatus.

Referring now to FIGS. 3, 4 and 5, two perspective drawings and a flow diagram are used to illustrate the method of operation of the present invention. The high pressure fluid source 36 engages the pressure actuator 12. The pressure actuator 12 measures the fluid pressure being transmitted from the high pressure fluid source 36 and determines whether the fluid pressure is at or below a predetermined threshold and conveys the pressure measurement 130 to the valve 14. The valve 14 is in direct communication with a supply of abrasive material 18 and a supply of compressed gas 60. The valve 14 in communication with the pressure actuator 12 opens or closes gates to inlets 20, 22 depending upon the fluid pressure. In this specific instance, if the fluid pressure is 1,000 psi or greater, the gate to the inlet 22 of the valve 14 is closed, abrasive 18 is allowed to flow to the flow conduit 62 and the compressed gas 60 is precluded from flowing to the flow conduit 62. If the fluid pressure measures less than 1,000 psi, the gate to inlet 20 of the valve 14 is closed and compressed gas 60 is allowed to flow to the flow conduit 62 and the abrasive 18 is precluded from flowing to the flow conduit 62. Once either compressed gas 60 or abrasive 18 is allowed to flow to the flow conduit 62, said material flows into the nozzle 118. Water jetting operations may become interrupted due to an arbitrary choice by the operator or by some unforseen mechanical failure. The present invention continually monitors the jetting operation 136 to determine whether or not the water jetting operation has become interrupted. If the water jetting operation has become interrupted 138, then the high pressure fluid stream 32 is diverted or vented through the dump valve 114 of the dump barrel 120. If the water jetting operation has not become interrupted then the high pressure fluid stream proceeds to the nozzle 118, where the high pressure fluid stream 32 comingles with the abrasive 18 and the mixture is jetted from the nozzle 118.

What is claimed is:

1. A non-clogging, high pressure slurry nozzle apparatus for intermittantly jetting abrasive material in combination with a high pressure fluid stream, comprising:

a nozzle for receiving the high pressure fluid stream having a first inlet orifice through which the high pressure fluid stream enters and a second inlet orifice through which one of abrasive material and a supply of compressed gas selectively enters, an outlet through which one of the high pressure fluid stream in combination with the abrasive material and the supply of compressed gas are selectively jetted, and a dump means for venting the high pressure fluid stream away from the outlet, wherein the supply of compressed gas automatically removes the abrasive material from the outlet when the high pressure fluid stream is diverted from the outlet;

a trigger for selectively jetting one of the high pressure fluid stream in combination with the abrasive material, and the supply of compressed gas through the outlet;

a valve for automatically controlling the flow of one of abrasive material and the supply of compressed gas to the second inlet orifice of said nozzle; and a pressure actuator, in communication with said high pressure fluid stream, having a two-position switch wherein at least one pressure differential in the high pressure fluid stream causes the two-position switch to engage said valve to flow one of abrasive material and compressed gas selectively to the second inlet orifice.

2. The non-clogging, high-pressure slurry nozzle apparatus as described in claim 1, further comprising:

a high pressure fluid source to supply the high pressure fluid stream to the first inlet orifice.

3. The non-clogging, high pressure slurry nozzle apparatus as defined in claim 2, wherein said high pressure fluid source is a high pressure fluid pump.

4. The non-clogging, high pressure slurry nozzle apparatus as defined in claim 3, wherein the pressure actuator monitors the pressure of the fluid exiting from the high pressure fluid pump.

5. The non-clogging, high pressure slurry nozzle apparatus as defined in claim 4, wherein the pressure actuator includes a pressure sensing means in operative association with the high pressure fluid stream, wherein the pressure sensing means detects at least one pressure differential in the high pressure fluid stream and in response thereto reverses the position of the two-position switch.

6. The non-clogging, high pressure slurry nozzle apparatus as defined in claim 5, the pressure sensing means comprising a pressure pin having a first end exposed to the high pressure fluid stream and a second end in compressional engagement against a coil spring.

7. The non-clogging, high pressure slurry nozzle apparatus as defined in claim 1, wherein said pressure actuator detects at least one pressure differential of the high pressure fluid stream flowing through a high pressure fluid conduit and in response thereto the flow through said valve selectively alternates between one of abrasive material and compressed gas.

8. The non-clogging, high pressure slurry nozzle apparatus as defined in claim 1, wherein the abrasive material is soluble.

9. The non-clogging, high pressure slurry nozzle apparatus as defined in claim 1, wherein the abrasive material is insoluble.

10. A non-clogging, high pressure slurry nozzle apparatus for intermittantly jetting an abrasive material in combination with a high pressure fluid stream, comprising:

a nozzle for receiving the high pressure fluid stream having a first orifice in operative association with a high pressure fluid conduit, through which the high pressure fluid stream passes and a second orifice in operative association with a high pressure flow conduit through which one of abrasive material and a supply compressed gas selectively enters and an outlet through which one of the high pressure fluid stream in combination with the abrasive material, and the supply of compressed gas are selectively jetted;

a trigger for selectively jetting the high pressure fluid stream through the outlet;

a dump means for venting the high pressure fluid stream away from the outlet;

a high pressure fluid pump to supply the high pressure fluid stream to the first orifice;

a pressure actuator, having a pressure sensing means and a two position switch, in communication with said high pressure fluid stream;

a valve for controlling the flow of one of abrasive material and a supply of compressed gas selectively to the second orifice of said nozzle;

a supply of the abrasive material selectively transmitted through said valve and through the high pressure flow conduit engaged to the second orifice of said nozzle, wherein said abrasive material commingles with said high pressure fluid stream and a mixture of high pressure fluid and abrasive material is jetted from said outlet; and a supply of compressed gas automatically transmitted through said valve and through the high pressure flow conduit to the second orifice of said nozzle for removing abrasive material from said high pressure flow conduit and from said nozzle and from said outlet.

11. The non-clogging, high pressure slurry nozzle apparatus, as defined in claim 10, wherein said valve selectivity alternates in restricting flow from one of compressed gas inlet when the pressure actuator detects low pressure in the high pressure fluid conduit and an abrasive material inlet when the pressure actuator detects high pressure in the high pressure fluid conduit.

12. The non-clogging, high pressure slurry nozzle apparatus, as defined in claim 11, wherein said valve is in operative association with the abrasive material and the supply of compressed gas such that when the flow of the high pressure fluid stream from the high pressure fluid pump is not engaged with the abrasive material in said nozzle, said pressure actuator activates said valve for restricting flow there through to compressed gas only which is received by said nozzle, and when the flow of the high pressure fluid stream from the high pressure fluid pump to said nozzle is engaged with the abrasive material in said nozzle, said pressure actuator activates said valve for restricting flow there through to abrasive material only.

13. The non-clogging, high pressure slurry nozzle apparatus as defined in claim 10, wherein the abrasive material is soluble.

14. The non-clogging, high pressure slurry nozzle apparatus as defined in claim 10, wherein the abrasive material is insoluble.

15. A method for preventing an abrasive material blockage in a non-clogging, high pressure slurry nozzle apparatus, comprising the steps of:

directing a high pressure fluid stream through an orifice;

mixing the high pressure fluid stream with an abrasive material to form a mixture;

jetting the mixture from a nozzle outlet;

interrupting the jetting of the mixture by directing the high pressure fluid stream away from the orifice to a dump means;

sensing the interruption in jetting of the mixture and in response thereto engaging an actuator to substitute a supply of compressed gas for the abrasive material; and jetting the supply of compressed gas automatically, in place of the mixture to prevent blockage and clogging of the nozzle outlet.

16. The non-clogging, high pressure slurry nozzle apparatus as defined in claim 15, wherein the abrasive material in soluble.

17. The non-clogging, high pressure slurry nozzle apparatus as defined in claim 15, wherein the abrasive material is insoluble.

* * * * *